428-908.8 SR
7/9/85 XR 4,528,231

United States Patent [19]
Lund

[11] Patent Number: 4,528,231
[45] Date of Patent: Jul. 9, 1985

[54] SLIP AND WEAR RESISTANT FLOORING AND COMPOSITIONS AND A METHOD FOR PRODUCING SAME

[75] Inventor: Thore Lund, Hofors, Sweden

[73] Assignee: SKF Steel Engineering AB, Sweden

[21] Appl. No.: 491,749

[22] Filed: May 5, 1983

[30] Foreign Application Priority Data

May 7, 1982 [SE] Sweden ..... 8202865

[51] Int. Cl.[3] ..... B44D 5/08; E04F 11/16; E04F 15/00

[52] U.S. Cl. ..... 428/148; 52/177; 52/181; 428/212; 428/242; 428/273; 428/283; 428/328; 428/329; 428/908.8; 523/150

[58] Field of Search ..... 52/177, 181; 428/148, 428/212, 242, 273, 283, 328, 329, 908.8; 523/150

[56] References Cited

U.S. PATENT DOCUMENTS

Re. 30,691 7/1981 Hallstrom et al. ..... 523/150

*Primary Examiner*—James C. Cannon
*Attorney, Agent, or Firm*—Eugene E. Renz, Jr.

[57] ABSTRACT

Wear and slip resistant floors are described comprising a suitable substrate and a surface layer comprising a synthetic resin, preferably polyester, as the matrix and containing uniformly distributed therein a mixed waste material derived from a steel grinding operation and being composed of from about 60 to about 85% by weight of coarse metallic particles having a particle size from about 0.2 mm to about 1 mm with a mean particle size of about 0.5 mm and fine primarily oxidic particles, having a particle size from very fine up to about 0.2 mm, with a mean particle size of about 0.07 mm. The surface layer may also contain fiber glass reinforcement and other additives.

6 Claims, No Drawings

SLIP AND WEAR RESISTANT FLOORING AND COMPOSITIONS AND A METHOD FOR PRODUCING SAME

The present invention relates to novel slip and wear resistant floors, comprising a suitable sub-flooring of the prior art having a slip and wear resistant surface layer supported thereon, and to compositions and a method for making the same.

It is known in the art to provide slip and wear resistant floors, the surface layer of which employs a synthetic resin as a matrix for uniformly distributed wear resistant particles of metal. However, it has previously been difficult to produce such floors in which sufficient metal particles were present in the surface of the floor due to the tendency of the heavy metal particles to settle to the bottom of the plastic matrix as a sedimentary layer.

It is an object of the present invention, therefore, to provide slip and wear resistant floors above a suitable sub-floor having a slip and wear resistant surface layer comprising a matrix of a suitable synthetic resin having uniformly distributed therein an inexpensive, readily available, slip and wear resistant material which can be reliably and permanently uniformly distributed in the slip and wear resistant surface layer of the flooring.

It is another object of the invention to provide a slip and wear resistant flooring having a surface layer containing a slip and wear resistant waste material having a specific gravity such that it remains suspended throughout the matrix, including the surface thereof, thereby providing a floor having excellent initial slip and wear resistance, and which maintains its initial slip and wear resistance indefinitely as the surface of the flooring is worn away in use. The invention also includes a method for producing such floors.

BRIEF DESCRIPTION OF THE INVENTION

The foregoing objects and others, which will become apparent below, are attained by forming a slip and wear resistant surface layer above a suitable substrate such as wood, concrete or other sub-flooring. The surface layer may be of any desired thickness and comprises a matrix of a suitable synthetic plastic, polyester resins being preferred. The resin substrate has uniformly distributed therein, an inexpensive waste material derived from conventional grinding operations performed on steel blanks or ingots prior to hot rolling them to form steel plates in a steel works, any cooling or lubricating agents used in the grinding operation which remain in the ground waste are preferably removed from the waste by methods known to the art, such as drying, pressing or leaching.

The ground waste obtained in this way differs from metal particles which have previously been used in slip and wear resistant flooring in that it is made up of two different components in such proportions and of such particle size, that the ground waste has a specific gravity such that it remains suspended on the synthetic plastic matrix after mixing and during polymerization or setting of the plastic. In this way, the ground waste used in the present invention does not settle to the bottom of the plastic matrix as in the prior art, but remains uniformly distributed throughout the matrix, even in the surface thereof.

The steel grinding waste used in the present invention is a mixture of two disparate particulate materials, one relatively coarse, and one relatively fine. The coarse component, consisting of steel particles constitutes about 60 to about 85% by weight of the mixed ground waste, commonly about 75% by weight. The particle size of the steel particles is from about 0.2 mm to about 1 mm, with a mean size of about 0.5 mm. If the coarses contain particles in excess of 1 mm it is desirable to remove them by screening or otherwise. The coarse metal particles may be of any type of steel; a typical material being about 58% iron and about 38% ferrous oxide, by weight.

The fines in the mixed waste are normally collected in a conventional cyclone dust separator prior to mixing with the coarse particles in conventional blending equipment. The fines range in size from very fine dust up to about 0.2 mm, with the mean particle size typically being about 0.07 mm. The fines, too, may be derived from any type of steel; a typical composition being about 65% ferric oxide and about 38% ferrous oxide. Such a composition, as with the coarses, is a typical mean value for particles obtained by grinding a variety of different special steels. These fines are employed in proportions of about 15% to about 50% by weight of the waste mixture.

It has been found that these proportions of the coarse steel particles and the oxide fines provide a mixed waste material which has a minimal tendency to settle in the plastic matrix. Indeed, the fines appear to aid in preventing the settlement of the coarser steel particles, since it has been found that this tendency to settle becomes too great if the waste mixture contains less than about 15% of the oxidic fines. On the other hand, the use of more than about 40% by weight of the fines, reduces the amount of coarse particles to the point where the desired slip and wear resistance of the floor are less than desired if the viscosity of the resin-particle mixture is suitable for floor covering purposes.

Not only the proportions of fines to coarses are important, but also the particle size of the components. As noted above, fines of the recited particle size and proportions aid in suspending the coarses in the matrix. The particle size of the coarses is also important. Steel particles larger than about 1 mm give undesirable properties to the floor, such as a tendency to catch and hold the sole of a shoe, to scratch a person walking bare foot, or tearing stockings and the like. On the other hand, coarse steel particles of from about 0.2 to about 1 mm are necessary to provide good mechanical strength, and slip and wear resistance.

As noted briefly above, the proportions of the waste mixture in the matrix of the surface layer are also important in achieving a suitable slip and wear resistant floor. If the amount of the mixed waste in the plastic matrix exceeds about 85% by weight of the surface layer with the recited proportions of coarses and fines, the viscosity of the resin-waste mixture becomes too high to achieve a suitable surface layer. On the other hand, if the proportion of grinding waste is too small, the proportion of synthetic resin is so high that the slip and wear resistance of the floor is seriously reduced. It has been found that the lowest proportion of grinding waste which provides a desirably slip and wear resistant floor is about 65% by weight.

It has been found serendipitously, that the typical portions of coarses to fines obtained from a grinding operation on a variety of special steels, i.e. 60 to 85% coarses and 40 to 15% fines, is such as to provide optimum properties in the flooring of the invention. For this reason, it is generally possible to use the grinding waste, as collected from the grinding operation, without the necessity to sort or otherwise adjust the proportions of fines and coarses in the mixed waste prior to use.

DETAILED DESCRIPTION OF THE INVENTION

Within the broad limits recited above, an especially preferred slip and wear resistant surface layer for a sub-floor is obtained by blending a grinding waste as described above, containing about 65 to about 85% of the two component grinding waste in a polyester matrix comprising about 4 parts of a polyester commercially available under the trade designation Jotun 42-00 with one part of another polyester available as Jotun 47-00. Such a mixture of grinding waste and polyester synthetic plastic has a viscosity suitable for forming a surface layer of any desired depth on a suitable sub-flooring, and having only a minor and negligible tendency of the coarse metallic particles to settle when the proportions of fines to coarses are in the ranges recited above.

A floor having a surface layer composed of the formulation recited above containing about 78% of the grinding waste, and in which the proportion of the fines is about 85% by weight of the resin-grinding waste mixture, has a slip proof surface and wear resistance similar to that of a floor made of cold rolled steel, and is obtained at an appreciably lower cost than a corresponding prior art floor made of a mixture of epoxy resin and sand.

While the novel floors described above are very serviceable per se, their impact resistance can be improved still further by the addition of fiber glass reinforcement to the surface layer. Such fiber glass reinforcement may take any suitable form known to the art. A preferred reinforcing element consists of a fiber glass web suitably having a weight of about 300 g/m$^2$ embedded in the surface layer.

After blending the fines and coarses to obtain the waste mixture, it is uniformly blended with the uncured polyester or other synthetic resin in conventional equipment. Conventional hardening or curing agents for the synthetic resin are also blended into the mixture which is then spread on the sub-flooring to the desired depth by conventional means. The fiber glass reinforcement, if used, is applied between two layers of the resin-waste mixture preferably so as to be disposed centrally in the surface layer.

Accelerators and coloring agents or inert fillers may also be added to the resin-waste mixture during the blending operation. Another desirable additive is a waxed polyester, i.e. a mixture of a polyester resin and a wax, which prevents emission of styrene from polyester resins containing the same during the covering procedure, thus preventing styrene pollution of the atmosphere.

While the invention has been described above in connection with certain preferred embodiments, those skilled in the art will recognize other embodiments within the scope of the appended claims.

I claim:

1. In a slip and wear resistant floor surface layer overlying a sub-floor in which the surface layer comprises a synthetic resin having metallic particles uniformly distributed therein to impart slip and wear resistance to said surface layer, the improvement which comprises:

said metallic particles being part of a mixture of the waste steel particles obtained in the conventional grinding of steel ingots prior to hot rolling to form steel plates;

said waste steel particles comprising about 60 to about 85% coarse steel particles having a particle size of from about 0.2 mm to about 1 mm, and about 15 to about 40% of fine oxidic particles having a particle size of about 0.2 mm, by weight of said particulate mixture;

said mixture of waste particles being uniformly distributed in a surface layer comprising about 15 to about 35% cured synthetic resin and about 60 to about 85% of said waste particles, by weight of said surface layer;

said proportions of coarse steel particles and fine oxidic particles being such that the fine oxidic particles aid in preventing settling of said coarse particles in the resin matrix prior to curing without the use of a separate thickening agent for the matrix resin; whereby a slip and wear resistant floor surface layer is obtained in which the particulate waste material is uniformly distributed throughout the floor surface layer including the surface thereof.

2. In a process for producing a slip and wear resistant floor surface layer overlying a sub-floor, in which the surface layer comprises a synthetic resin having metallic particles distributed therein to impart slip and wear resistance to said surface layer, the improvement which comprises:

as a new use for an old material, incorporating a particulate waste material obtained by grinding steel ingots prior to hot rolling the same in an uncured synthetic resin so as to be uniformly dispersed therein;

applying said uncured resin-particulate waste mixture to a sub-floor in a layer thick enough to provide a finished floor of sufficient thickness to provide a durable floor;

said uncured resin-particulate waste material mixture comprising about 15 to about 35% synthetic resin and about 60 to about 85% particulate waste material by weight of the mixture;

said particulate waste material comprising about 60 to about 85% coarse steel particles having a particle size of from about 0.2 mm to about 1 mm, and about 15 to about 40% of fine oxidic particles having a particle size of about 0.2 mm, by weight of the particulate mixture;

said proportions of coarse steel and fine oxidic particles providing a resin-particle mixture suitable for floor covering purposes and in which the fine oxidic particles aid in preventing settlement of the coarse steel particles without the use of a separate thickening agent for the matrix resin; and curing the resin matrix in situ to provide a resin-particle slip and wear resistant surface layer; in which said particulate waste material is uniformly distributed throughout the floor surface layer including the surface thereof.

3. A floor surface layer of claim 2 wherein the matrix is a polyester resin containing fiber glass reinforcement.

4. A floor surface layer of claim 2 wherein the particulate waste mixture is obtained by blending said coarse and fine particles.

5. A floor surface layer claim 2 wherein the mixed particulate material is obtained as a waist product in the grinding of steel ingots prior to hot rolling to form steel plates.

6. A floor surface layer of claim 2 wherein the particulate waste material comprises about 75% coarse steel particles having a mean size of about 0.5 mm and about 25% of fine oxidic particles having a mean size of about 0.07 mm.

* * * * *